United States Patent [19]

Fitzgerald

[11] Patent Number: 4,869,341

[45] Date of Patent: Sep. 26, 1989

[54] AUTOMATIC CONTROL OF WORK PLATFORMS

[76] Inventor: Frederick P. Fitzgerald, 9 Osterley Avenue, Bridgewater, Australia

[21] Appl. No.: 247,034

[22] Filed: Sep. 20, 1988

[30] Foreign Application Priority Data

Sep. 21, 1987 [AU] Australia ..... PI4470

[51] Int. Cl.[4] ..... E04G 3/10

[52] U.S. Cl. ..... 182/19; 182/144

[58] Field of Search ..... 182/19, 18, 144, 147

[56] References Cited

U.S. PATENT DOCUMENTS 2,957,582 10/1960 Lusk ..... 182/144
4,237,999 12/1980 Batreau ..... 182/19
4,625,830 12/1986 Wehmeyer ..... 182/19

FOREIGN PATENT DOCUMENTS 47538 9/1985 Australia .
117862 9/1983 European Pat. Off. ..... 182/19

*Primary Examiner*—Reinaldo P. Machado
*Attorney, Agent, or Firm*—Brown, Martin, Haller & McClain

[57] ABSTRACT

This invention relates to the automatic control of work platforms and in particular to a circuit means that provides a safe operation and automatic relevelling of a work platform that is being raised and lowered by electrically powered hoists. Angle sense means are used to detect out of level orientations of the platform either along the longitudinal or transverse axis of the platform. When the angle sense means signals are interpreted by the circuit means appropriate hoist control signals stop the travel of the platform for a pre-determined period, control the hoists to bring the lowest portion of the platform up into a substantially level position, stop the travel of the platform for a pre-determined period and recommence the direction of travel of the platform.

9 Claims, 6 Drawing Sheets

AUTOMATIC CONTROL OF WORK PLATFORMS

This invention relates to the automatic control of work platforms and in particular to a circuit means that provides safe operation and automatic relevelling of a work platform that is being raised and lowered by hoists.

Common use is made of work platforms that are raised and lowered by hoists (where hoist is equivalent to winch) wherein the work platforms are suspended by cables from a fixed elevated point. Movement of the work platform up and down the cables enables the work platform to access areas such as the external surfaces of high rise buildings, and are useful in many other applications where access is required to otherwise inaccessible surfaces.

Presently a hoist is affixed to each end of a work platform whereupon two persons are used to control the upward or downward control of those hoists. With this configuration either the different speeds of the hoist motors or the different operation of each of the hoists by the operators results in the platform becoming more than substantially out of level.

A further problem encountered is the oscillations created by the stopping and starting at either of the sides of the platform of the hoist motors by their respective operators. This process places a large amount of strain on the suspension cables and increases the wear and tear on the hoist motors when starting and stopping during oscillation periods.

There exists control means which allow a single operator to control both hoist motors simultaneously, however the different hoisting speeds of these motors often results in the platform moving from a substantially level position to an unsafe inclined position. Under manual control it is not uncommon that once the hoist motor is switched off to correct this situation, the inertia of the work platform will continue to cause oscillations of the platform as the suspension cables extend and contract. Obviously, if a hoist motor is switched on under such circumstances, quite excessive loadings on the hoist and motor can result.

Should a working platform become unlevel, then in order to prevent any worsening of the situation, it is essential that all of the hoist motors be prevented from continued operation. Some of the prior art automatic control systems, function by allowing the hoist at the lower end of the work platform to continue operating while the high side hoist remains stationary, and once the platform is level the de-energised hoist is once again turned on. Obviously, it is preferable that if a work platform were to become inclined, then both hoist motors should be de-energised, and the work platform then levelled. Also the turning off and then on of the hoist motor creates, as it is mentioned above, a great deal of oscillating motion, which may result in the malfunction of the inclination sensing means, in addition to the increased wear and tear upon the hoist motors.

It is also vitally important that all the normal control commands i.e. UP, DOWN and EMERGENCY STOP be unaffected in their operation and safety aspects.

It is an object of this invention to interface to the existing controls and operation of commercially available hoists and ensure that their operation is unchanged from normal operating procedures and additionally introduce safety features to enhance the operation of the platforms which are integral to the embodiment of the invention.

Therefore, it is an object of this invention to provide an automatic levelling control means (incorporating desired safety features) and that overcomes the above-mentioned problems and allows a single operator to control the motion of the platform upwards and downwards along the suspension cables.

In its broadest form, the invention comprises a work platform control means for maintaining the platform in a substantially level position when being raised or lowered by two or more electrically powered hoists comprising an inclination sensing means that provide a signal should the platform be in an out of level position, and a circuit means that, (i) senses the signal of the inclination sensing means, and stops operation of said hoists when the platform is out of level, (ii) causes a first delay period, (iii) after said first delay period operates the hoist on the low side of the platform until the platform is substantially level, where upon the operation of the hoist is stopped, (iv) causes a second delay period, and (v) after said second delay period recommences operation of all said hoists to continue raising or lowering the platform.

said pair of hoists, a circuit means providing a first delay period after which the hoist on the low side of the platform is operated until the platform is level, and then stops operation of that hoist, a further circuit means providing a second delay period after which the pair of hoists are operated to continue raising or lowering the platform.

In a further aspect of this invention, the automatic control means is provided with a de-bounce circuit where the output from the inclination sensing means is provided with hysteresis to ensure that the threshold inclination angles have occurred. These threshold angles represent limits of what is considered not substantially level. The de-bounce circuit is used to filter the inclination sensing device output so as to provide definite indication to the hoist controller that these thresholds have been achieved. This de-bounce circuit ensures that any oscillations caused by the stopping or starting of the hoist in an upward or downward motion are interpreted correctly.

The automatic control means is preferably located between the two hoist motors and interfaces the external power supply to the hoist control relays hoists. This enables the control means to be fitted to existing work platforms without major electrical wiring changes.

Miniaturisation of this preferred embodiment could be such that the level control means may be incorporated into the respective hoist housings with integral or external inclination sensing devices and suitable connections between hoists at each side of the working platform.

Additionally, this invention could be used to allow the joining of like working platforms and thus allow the movement of a number of platforms in concert with each other, for example a number of platforms interlinked to move up and down together.

Further, the invention could be used to control the automatic control of level of the platform in the transverse axis, by incorporating pairs of inclination sensing devices orthogonal to the existing pairs of inclination sensing devices and using the existing or an additional circuit to sense their output at preset angles.

A still further application of this invention would be the control of the hydraulic levelling legs of vehicle chassis which support cranes and the like while stationary to stabilise the chassis of the vehicle during crane operation.

A preferred embodiment of the invention will now be described, but it will be understood that the invention need not be limited to any one or combination of the following features.

In this embodiment, an automatic control means is provided to maintain a platform that is being operated by hoists in a level position. A pair of hoists is preferably attached at each end of the longitudinal axis of the work platform. The control system is preferably positioned in the centre of the work platform along one of its faces and the power supply input to both hoists is directed via the automatic level control means and associated safety control means.

In order that the invention may be more clearly understood, reference will now be made to the accompanying drawings, wherein.

Figure 1:
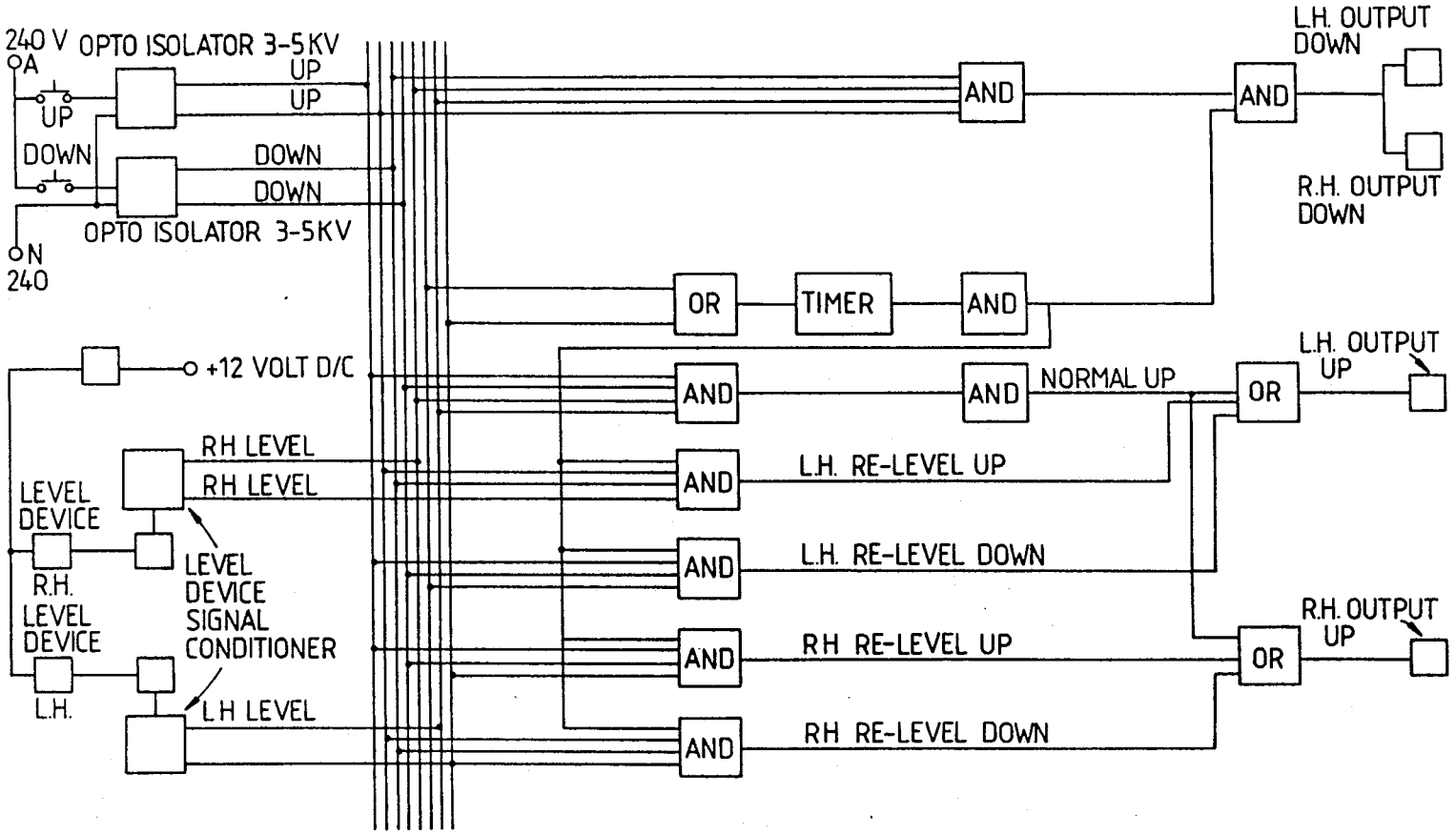
FIG. 1 shows a schematic of the logic of the automatic levelling controller.
Figure 2:
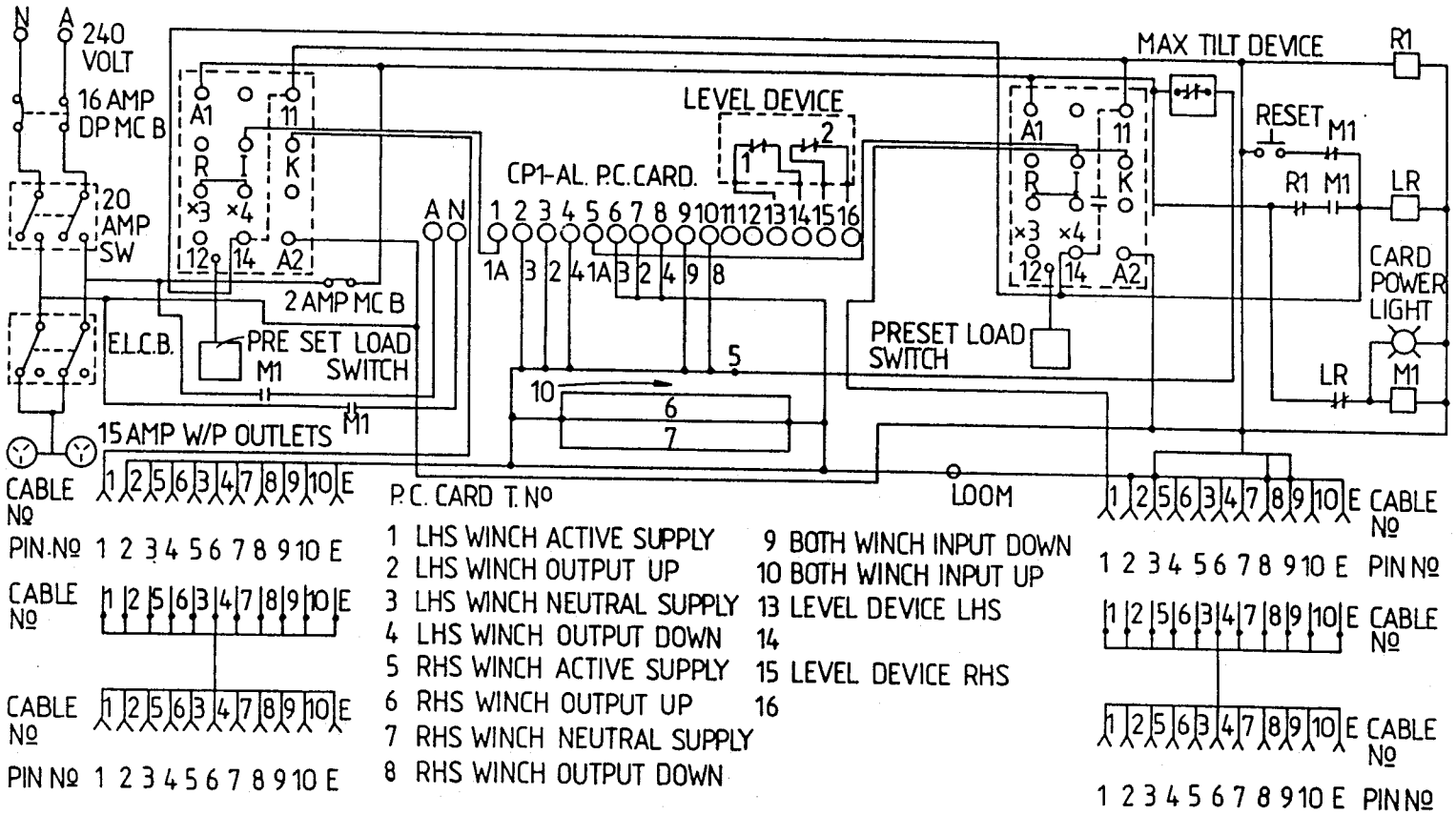
FIG. 2 shows a circuit diagram of the automatic levelling controller when used with an ASTRO winch.
Figure 2A:
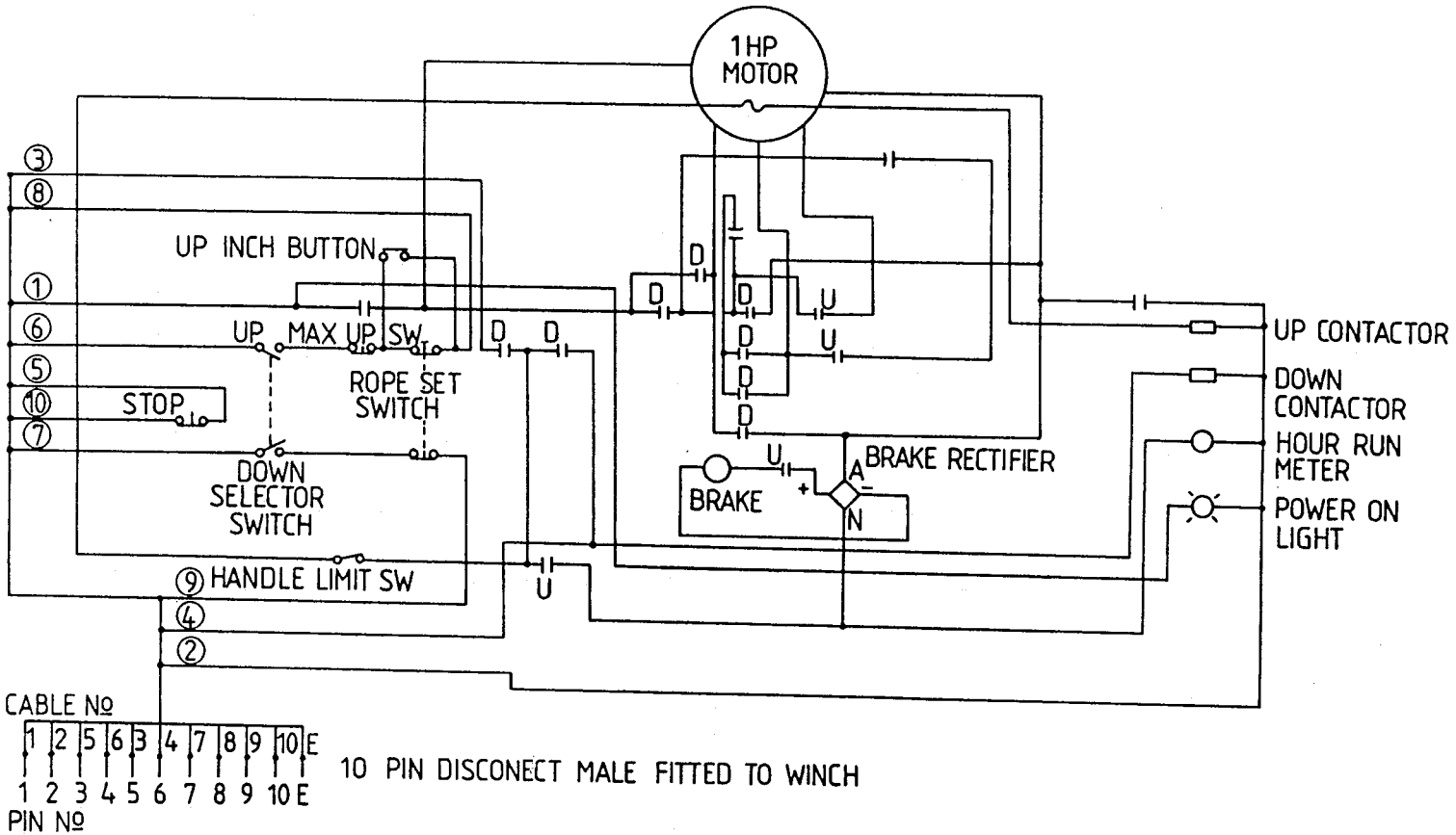
Figure 3:
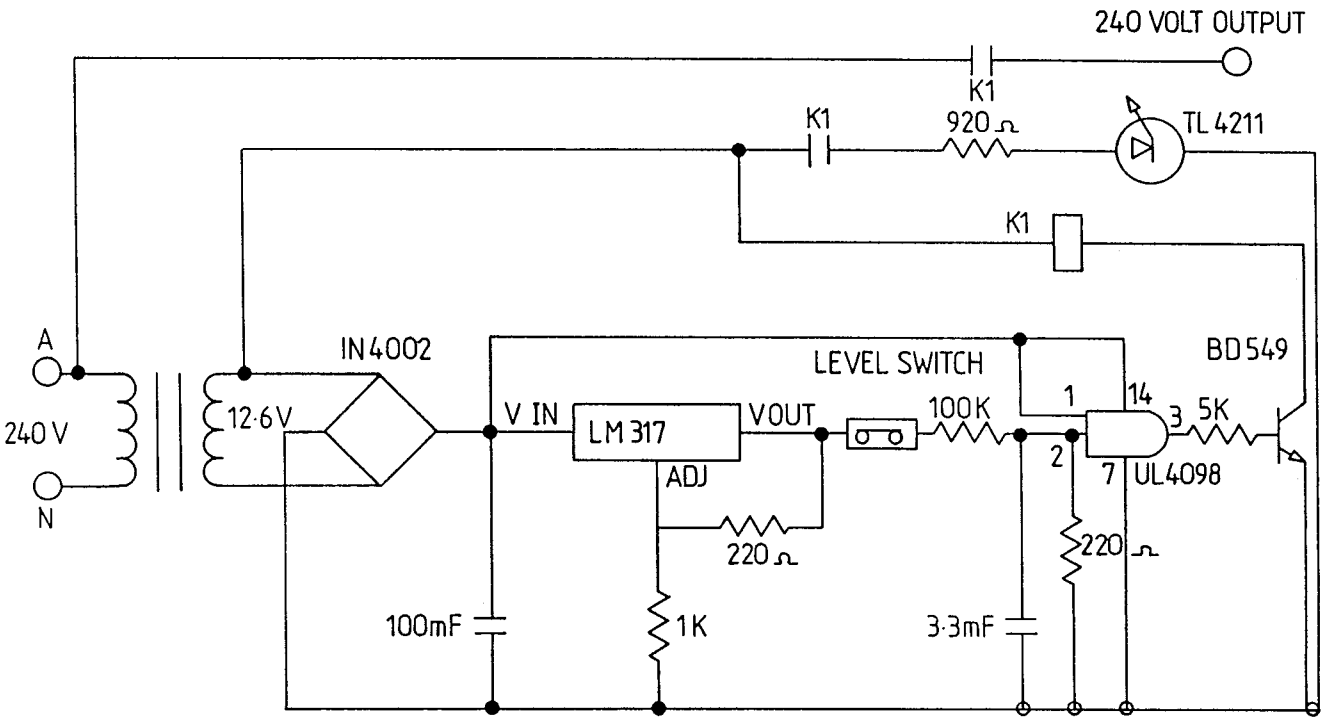
Figure 4:
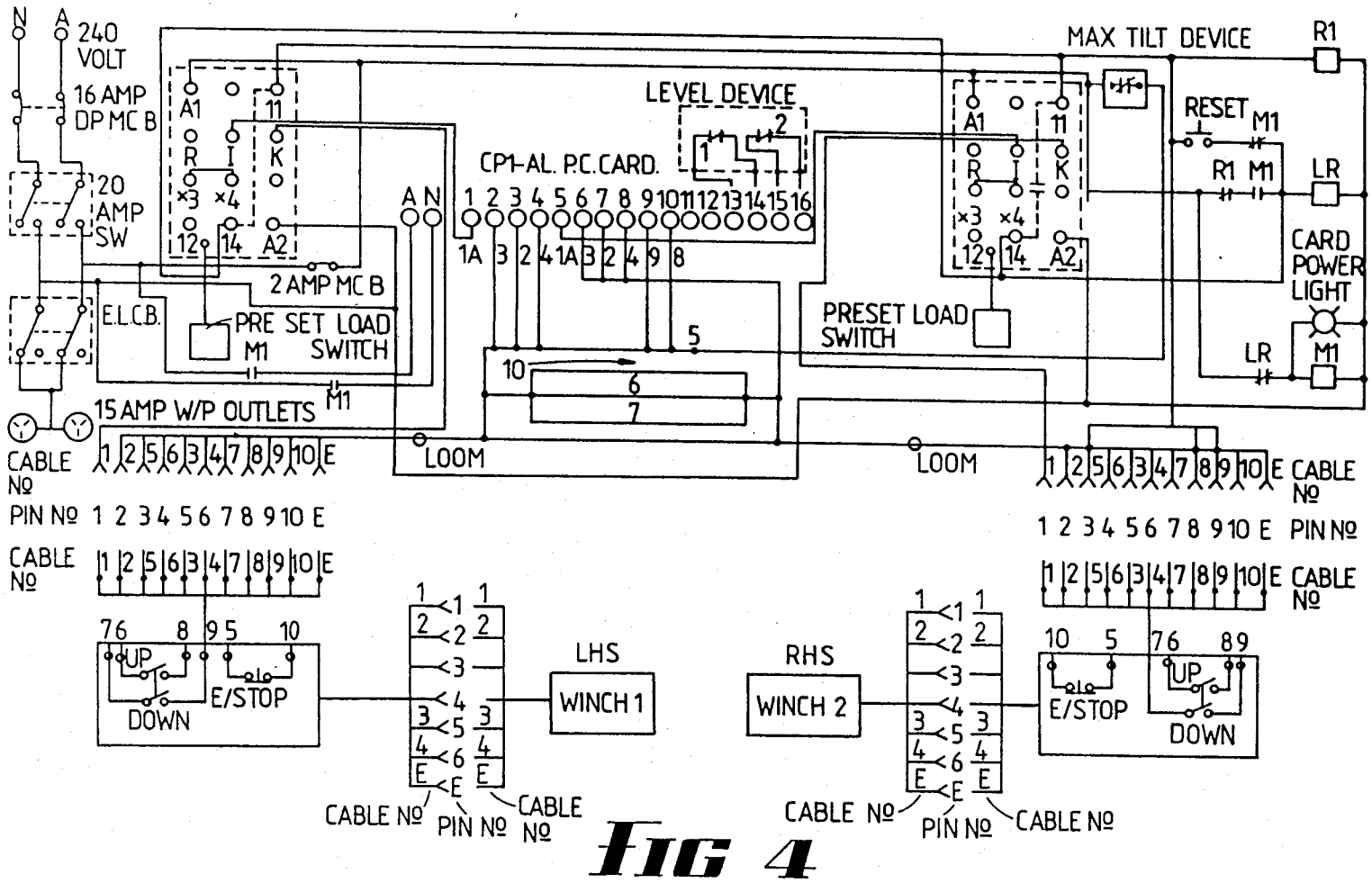
Figure 5:
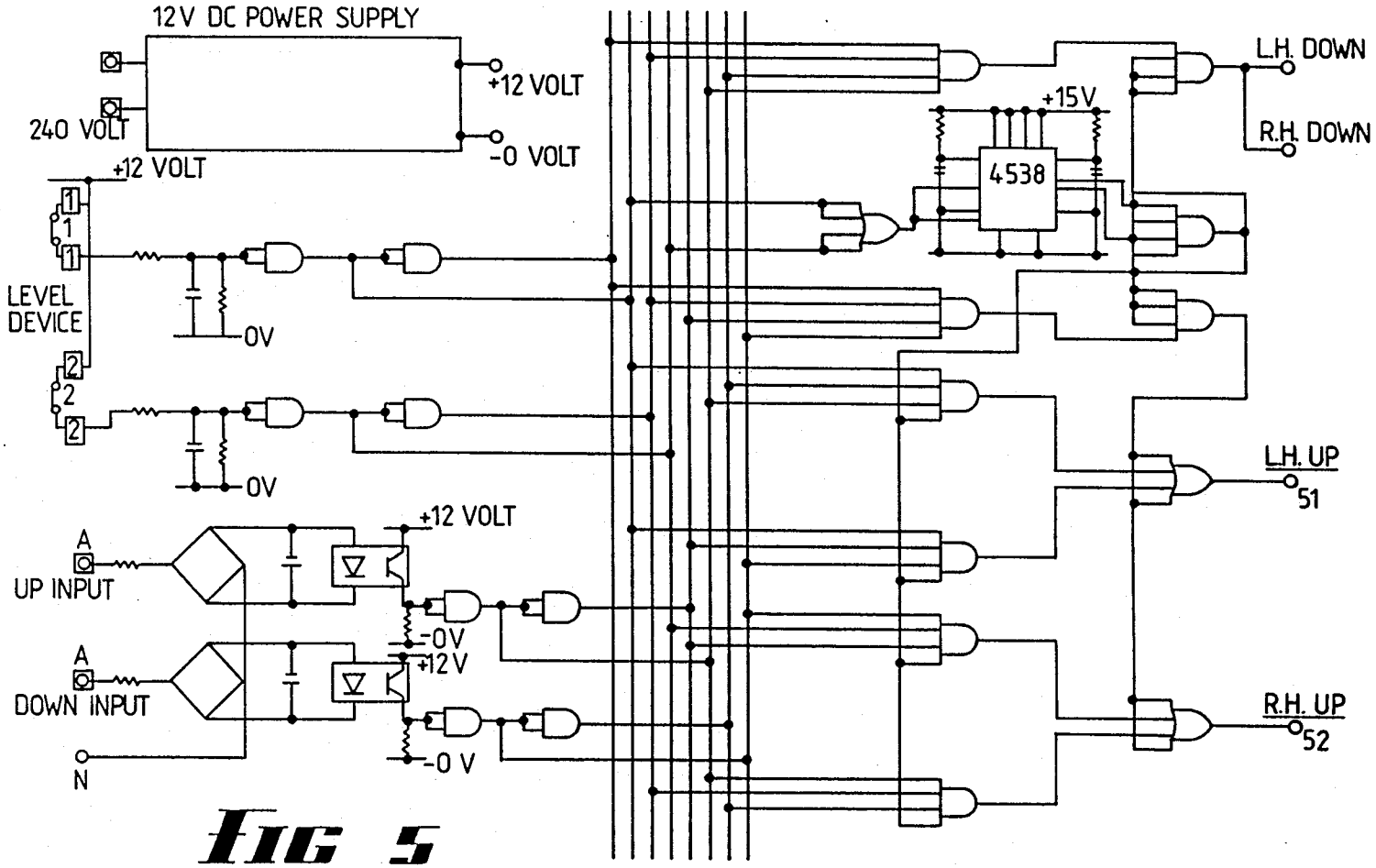

FIG. 2*a* shows a circuit diagram of the changes required for the automatic level controller when used with an ASTRO winch; and FIG. 3 shows the de-bounce circuit which interfaces the inclination sensing device with the automatic level controller;

FIG. 4 shows a further circuit diagram of the automatic levelling controller when used with an ALPHA winch device;

FIG. 5 shows a circuit embodiment of FIG. 1.

The preferred automatic level control means embodiment comprises Up/Down and Emergency Stop buttons which are hand-held or integrated into each hoist housing; a control card comprising an inclination sensing device which in this embodiment is a pair of mercury switches, switch de-bounce circuits; main circuit breaker; control, latch and main contactor relays circuit; an overload current sense circuit and a logic controller circuit.

The automatic level control means is interposed between the A.C. single phase power supply and the left and right hand hoists and acts upon control signals from the controllers. In further embodiments a single controller can provide the necessary control signals.

In addition to the above, a changeover switch is available to direct the incoming A.C. supply to General Purpose Outlets via an Earth Leakage Circuit Breaker (ELCB) for use while the working platform is in a stationary position. The hoists cannot be operated while the General Purpose Outlets (GPO's) are in use. This is forced upon the operator for safety reasons and additionally reduces the power requirements to the working platform. Lighting upon the working platform would require a separate A.C. supply.

A variety of features are incorporated in this device which includes a maximum dead and live load detection device and circuit, which provides automatic cut-out of hoist operation, while preset limits are exceeded.

In this preferred embodiment the operator or operators select an upward mode of travel by selecting "UP" on the remote hand controls. One operator can operate the platform since the "UP" and "DOWN" controls are not momentary contact type switches. Both hoists travel in the upward direction until one hoist becomes out of level by approximately 5°. When this occurs, both hoists stop. After 1.8 seconds, the lower of the two winches climbs until the platform is no longer greater than 5° out of level and then stops. Both hoists remain static for 3 seconds, then both continue in the upward direction until one person releases the selector switch or presses the emergency stop button.

In this embodiment it is a characteristic of the mercury switches that its signal is only available at the predetermined angle and the combination of the debounce circuit hysteresis and winch motor overrun ensure that the out of level return process provides a platform angle of approximately 0° to the horizontal. Alternative embodiments utilizing a range of angle sensing signals will allow greater accuracy of level positioning.

Alternatively, the operator or operators select a downward mode of travel by selecting "DOWN" on the remote hand controls. Both hoists travel in the downward direction until one hoist becomes out of level by approximately 5°. When this occurs, both hoists stop. After 1.8 seconds, the lower of the two hoists climbs until the platform is no longer greater than 5° out of level and then stops. Both hoists remain static for 3 seconds, then both continue in the downward direction until one person releases the selector switch or presses the emergency stop button.

This embodiment provides circuits for control of an 'ASTRO' winch as manufactured by POWER CLIMBER N.V., Smallestraat 28, B2008, ANTWERPEN, BELGIE 03-2314856 but a further embodiment for control of an 'ALPHA' winch manufactured by SKY CLIMBER N.V., ANTWERPEN, BELGIE, 03-2314856 is also given.

In this embodiment, the inclination sensing device comprises a pair of mercury switches. In use it has been found necessary to encapsulate the switches to lessen the likelihood of damage. An arcuate shaped mercury switch is best employed, known as a banana switch, which is designed in this embodiment to become an open switch when inclined to the horizontal at 5° or more. A first pair (one for each angle either side of the perpendicular) of mercury switches is used to detect the out of level condition i.e. greater than or equal to 5° and a second pair of mercury switches is used to detect the extreme out of level condition i.e. greater than or equal to 8°. The second pair of mercury switches, if activated, ceases operation of the hoists until a reset procedure is undertaken which includes manual correction of the platform level and will not allow resumption of normal operation until the platform is substantially level. These mercury switches are mounted within the equipment enclosure which itself is designed to be mounted on a rail parallel to the longitudinal axis. It can be seen that a similar arrangement of inclination sensing devices could be located within or outside the equipment enclosure to detect inclination orthogonal to the transverse axis of the working platform.

Both mercury switches will make and break contact through their circuit while in the vicinity of their trip angles, and more particularly a rapid make and break occurs if the platform is oscillating while at the vicinity of the trip angle. Therefore, circuitry is provided to de-bounce or add a hysteresis to the contact brake action. FIG. 3 shows the conditioning circuit that achieves this function. With the values of components shown, the time taken to switch off the conditioning circuit is 0.67 seconds; when the mercury switch is closed and the time taken to switch on the output when the switch opens again is 0.39 seconds. As shown the output of the conditioning circuit is fed to a transistor which energises a relay and its contactors switch the 240 V to the logic controller, and operate an indicator LED. This foregoing circuit is associated with the first pair of mercury switches which are set to detect the tilt of the platform equal to or greater than 5°.

Hoist operation is controlled via the automatic level control device which includes a logic controller. A representation of the logic which controls the various operations is provided in FIG. 1. This logic is powered up upon the switching of the master control switch to "WINCH" and the MAXIMUM TILT level sense safety circuit is brought into circuit to ensure a substantially level platform exists prior to allowance of the operation of the hoists. Additionally, if the hoists are not plugged into hand controllers and in turn the hand controllers are not plugged into the control box, no operation of the hoists can be effected. If both controllers are ON, then they must as forced by the logic, select the same direction of travel or no operation of the hoist can be effected.

As shown in FIG. 2, the current drawn by the two hoists is monitored by the Over Current Protector device and when a preset quantity is reached, all hoist operation is ceased. The preset quantity is determined from manufacturers' recommendations and safe working practices in relation to dead and live loading of the platform. Different platform sizes and loadings require different settings.

This overload signal and the 8° maximum tilt signal are detected by a latching relay and in turn actuate the main contactor to cease the operation of the hoists. This trip function will not automatically reset. A manual reset procedure must be initiated, either after a lessening of loading, or manual re-levelling of the platform.

The implementation of this invention is shown in but one way and there will exist to the skilled addressee numerous other suitable circuits. However, the functions, performed in this embodiment by relays, are an integral requirement of the operational and safety features of this invention.

POWER UP

Referring to FIG. 2, with the actuation of the 16 Amp Double Pole Miniature Circuit Breaker A.C., power is supplied to (a) the 20 Amp Double Pole Two Position switch, and (b) the 2 Amp Control Miniature Circuit Breaker (M.C.B.) (positioned within the device and is not capable of being activated unless the device is opened).

The 20 Amp switch allows selection of either WINCH operation or GPO usage. In the GPO position, A.C. supply is fed via an Earth Leakage Circuit Breaker to a pair of 15 Amp Weatherproof GPO's. In this mode, as is clear from the circuit, the WINCHES cannot be operated.

In the WINCH position, both the Active and Neutral of the A.C. supply are fed via Auxilliary Contacts M1 and M1 of the Main Contactor relay to the Control Platform 1. Automatic Level-Printed Circuit Card (CP1-AL-PC Card) has ultimate control of the A.C. source to the winches via pin 1 cable 1A for the left hand side winch and pin 5 cable 1A to the right hand side winch.

A.C. supply for the remainder of the device is sourced via the 2 Amp M.C.B. The over current protectors at pin A1 are first followed by the first of two pairs of inclination sense devices. A prior description provides details as to their operation. This first pair is the Maximum Tilt Sense Device (i.e. 8° preset). As will become clear after explanation of the circuit, if either of this pair of switches is opened as a result of the platform tipping greater than or equal to 8°, the platform will totally stop and a manual reset procedure will need to be conducted prior to resumption of operation. This Maximum Tilt Sense Device is also in series with the Emergency STOP Button (located on the ASTRO winches) referred to in FIG. 2*a*, and has the same effect and consequences when they are operated. The circuit for this interconnection begins at the output side of the Normally Closed (N/C) Tilt Sense Device and via cable 5 connects to pin 3 of the 10 pin connect/disconnect device associated with the left hand side (LHS) winch. Continuing via cable 5 of the 10 core plus earth 1.5 mm Multi-Core PVC Flex cable to pin 3 of the LHS 10 pin winch disconnect female.

Via the internal cable 5 of the winch to the N/C Emergency STOP Button and return via pin 10 cable 10 of the Multi-Core cable, pin 10 cable 10 of the connect-/disconnect device associated with the LHS winch and via cable 10 (link) to the Right Hand Side (RHS) connect/disconnect pin 10. Continuing via cable 10 to pin 10 of the RHS winch, via the N/C Emergency STOP Button on the RHS 'ASTRO' winch. Thus via pin 5 cable 5 the circuit follows via cable 5 through the RHS connect/disconnect device and onto pins 8 and 9 of the device via a link.

The following description involves the operation of three relays referred to as the Control Relay (R1), Latch Relay (LR) and Main Contactor (MI). They are interrelated via their auxilliary contactors and ultimately via the Main Contactor Auxilliary contacts which control the supply of A.C. on both the Active and Neutral sides to the CP1-AL-PC card.

It is these contacts which bring about the cessation of winch operation.

At power up, assuming that the circuit switches thus far described (i.e. Max Tilt, Emergency STOP switches) are closed and an Over Current condition does not exist the following will apply.

R1 is energised and since its coil and its contactors react more quickly than the MI contactor coil and contacts, the R1 Auxilliary contact opens and remains open while R1 is energised. Therefore LR, which is a momentary latching relay, is not energised from the source Active via R1 or the open MIAux1. MIAux1 is open since MI has not yet fully energised, but, when it does via the closed LRAux, MI will then close MIAux1 contact.

Thus the LIVE condition of the relays (O=open, C=closed, E=energised, NE=not energised) is as follows.

| | R1 | R1 Aux | LR | LR Aux | MI | MI Aux 1, | 2, | 3, | 4 |
|---|---|---|---|---|---|---|---|---|---|
| LIVE | E | O | NE | C | E | C | O | C | C |

EMERGENCY BUTTON/MAX TILT DEVICE OPERATION

Since these devices are N/C and in series when any one of them are operated, R1 is de-energised for an equivalent time, which closes R1 Aux and LR is energised (pulsed) for that short period as well, via the momentarily closed R1 Aux contact and also closed MIAux1 contact. With LR momentarily energised LRAux opens and de-energises the MI coil. This in turn operates the MIAux1 to open, thus closing off the supply to the LR coil. Concurrently, with the MI coil de-energised the MIAux3 and 4 contact open and A.C. supply is ceased to the CP1-AL-PC Card.

| | R1 | R1 Aux | LR | LR Aux | MI | MI Aux 1, | 2, | 3, | 4 |
|---|---|---|---|---|---|---|---|---|---|
| Momentary EME/TILT | NE | C | E | O | NE | — | C | — | — |

Note that the LRAux contact is a mechanically latched relay and requires a pulse to operate 'ON' and a pulse to operate 'OFF'.

| | R1 | R1 Aux | LR | LR Aux | MI | MI Aux 1, | 2, | 3, | 4 |
|---|---|---|---|---|---|---|---|---|---|
| Post Momentary EME/TILT | E | O | NE | O | NE | O | C | O | O |

OVER CURRENT PROTECTION

An Over Current Protector is associated with each of the winches. A DOLD type MK9053 current protector relay manufactured by E. DOLD & SONS, Posfach 60, D-7743 Furtwayen, Schwartzwald, WEST GERMANY, is used. This relay measures the arithmetic average of the rectified measuring current.

The auxilliary voltages required are provided via an Active to the A1 terminal and Neutral to the A2 terminal. External control is provided for setting of a response/trip valve and a release/reset valve via an externally adjustable hysteresis potentiometer. These settings are made using test loads and different settings are required for various platform sizes and loadings.

When the predetermined trip current is sensed the auxilliary contact provided within the relay is closed and the Active via its own pin 11 is shunted to the coil of LR via its own pin 14 output.

This initiates the shut-off process as described for the Max Tilt/Emergency STOP sequence. The current protector relay auxilliary contact is operated open again, after the hysteresis period has elapsed and the protector relay is reset for normal monitoring operation. The hysteresis period is preferably less than 5 seconds otherwise the LR relay coil will burn out.

RESET

After manually correcting the cause of the 'STOP' the respective relays will have the following condition.

| | R1 | R1 Aux | LR | LR Aux | MI | MI Aux 1, | 2, | 3, | 4 |
|---|---|---|---|---|---|---|---|---|---|
| Pre RESET | E | O | NE | O | NE | O | C | O | O |

When the Reset Switch is pressed and mode A.C. active is available via the closed Max Tilt Device circuit via the Emergency STOP buttons on the winches to the RESET switch. Since MIAux2 contactor is closed the reset switch allows the LR coil to be energised which mechanically resets LRAux to the closed position thus allowing Active to the MI coil. MIAux2 opens thus negating the RESET switch function and MIAux's 3 and 4 are then closed restoring A.C. to CP1-AL-PC card.

| | R1 | R1 Aux | LR | LR Aux | MI | MI Aux 1, | 2, | 3, | 4 |
|---|---|---|---|---|---|---|---|---|---|
| Post RESET | E | O | NE | C | E | C | O | C | C |

UP AND DOWN CONTROL

In this embodiment UP and DOWN controls are available on the ASTRO winch housings or on separate hand controllers in the ALPHA winch configuration. A further embodiment would be to link across these control switches and splice the control wires and place buttons in series to the appropriate control lines and provide alternative UP and DOWN control switches. The Emergency STOP buttons could be replaced in a similar manner.

An embodiment could incorporate these alternative controls into the enclosure of the automatic levelling device and thus allow a neater and more convenient device and enable one occupant to control all the operations of the platform.

FIG. 4 displays a schematic of the logic which controls the UP and DOWN function of the Automatic Level Control device. This logic is contained in the CP1-AL-PC card circuit. FIG. 5 shows a circuit embodiment of this logic.

UP SIGNAL INPUT

This signal to the CP1-AL-PC card is generated as a consequence of the operation of the UP switches on both the winches (Astro embodiment). A.C. is sourced from pin 8 of the RHS connect/disconnect device. This AC is communicated via the Maximum Tilt device and Emergency STOP switches, via cable 8 to pin 8 of the RHS winch, the circuit is taken via the Rope Set switch and the RHS winch UP switch which is integral to a two position UP, DOWN selector switch. The switch can only be set up or down, and as will be apparent both switches in both winches must be of the same selection. Via cable 6 to pin 4 of the winch the circuit is taken to pin 4 of the connect/disconnect device via cable 6. The circuit carries along cable 6 to the LHS connect/disconnect device pin 4 and continues along cable 6 to pin 4 of the LHS winch connector. Via cable 6 to the UP switch and when made to the Rope Set Switch then via cable 8 to pin 8 of the LHS winch connector. Via cable 8 to pin 8 and then cable 8 through the LHS connect/disconnect to cable 8 connected to pin 10 of the CP1-AL-PC card. This pin is designated the UP input.

An A.C. signal present on this input denotes an UP command for both winches.

UP SIGNAL OUTPUT

This signal is generated after the CP1-AL-PC card receives the UP signal input.

Both winches simultaneously receive UP energisation current. Pin 2 of the CP1-AL-PC card provides UP energisation to the LHS winch via cable 3, pin 5 of the LHS connect/disconnect device, to pin 5 of the LHS winch, then via cable 3 of the ASTRO winch, which then drives the LHS of the platform upward.

Pin 6 of the CP1-AL-PC card provides UP energisation to the RHS winch via cable 3, pin 5 of the RHS connect/disconnect device, to pin 5 of the RHS winch, then via cable 3 to the ASTRO winch then drives the RHS of the platform upward.

A much abbreviated description of the DOWN SIGNAL follows since the operation is the same as for the UP SIGNAL albeit on different circuits.

DOWN SIGNAL INPUT

This signal to the CP1-AL-PC card is generated as a consequence of the operation of both the DOWN switches on the winches (ASTRO embodiment as per FIGS. 2 and 2*a*). A.C. is sourced from pin 8 of the RHS connect/disconnect device. Via cable 9 to pin 9 of the RHS winch, via the Rope Set switch, the DOWN switch via cable 7 to pin 7 of the RHS winch and then via cable 7, across to the LHS connect/disconnect to pin 7 of the LHS winch, via the DOWN switch, the Rope Set switch via cable 9 to pin 9 of the LHS winch and to cable 9 leading to pin 9 of the CP1-AL-PC card. This pin is the INPUT DOWN pin and is activated when A.C. is impressed on pin 9.

DOWN SIGNAL OUTPUT

This signal is generated after the CP1-AL-PC card receives the DOWN signal input. Both winches simultaneously receive DOWN energisation current.

Pin 4 of the CP1-AL-PC card, via cable 4 to, pin 6 of the LHS connect/disconnect device, via cable 4 to pin 6 of the LHS winch, then via cable 4 of the ASTRO winch, which then drives the LHS of the platform downward.

Pin 8 of the CP1-AL-PC card, via cable 4 to, pin 6 of the RHS connect/disconnect device, vai cable 4 to pin 6 of the RHS winch, then via cable 4 of the ASTRO winch, which then drives the RHS platform downward.

WINCH ACTIVE

While power is available to the relay circuits, MIAux's 3 and 4 are closed. In particular MIAux3 is connecting A.C. Active to the CP1-AL-PC card. Terminals 1 and 5 of the CP1-AL-PC card via cables 1A, via inputs of the over current protectors, exiting via terminal k on cable number 1, pin 1, cable 1 to pins 1 on both the LHS and RHS winches.

WINCH NEUTRAL

In particular MIAux4 is connecting A.C. Neutral to the CPI-AL-PC card. Terminals 3 and 7 of the CP1-AL-PC card via cable 2, via pin 2 of both the connect/disconnect devices and to pin 2 of the RHS and LHS winches.

CP1-AL-PC Card

This card contains a circuit which mimics the logic provided in schematic form in FIG. 1 and shown in detail in FIG. 5.

The platform out of substantial level signals are provided by inclination sensing switches, comprising, in this embodiment, mercury switches designed to go open circuit when an angle of 5° or greater is achieved. If the platform was proceeding upwards or downwards and the LHS winch becomes higher than the RHS winch and the platform is at an angle of 5° or greater to the horizontal, then the mercury switch connected between terminals 13 and 14 of the CP1-AL-PC card go open circuit. Both winches stop. A 1.8 second time delay takes place allowing any winch cable bounce to cease. The lower RHS winch will then continue upwards until the platform is level as determined by the level sense devices becoming closed circuit. Both winches stop and a 3 second delay takes place allowing any winch cable bounce to cease. Both winches then travel in their given direction of travel.

In the normal mode of the logic circuit a signal from the left hand or right hand angle sense device initiates via the OR gate the first 1.8 second time delay before the right or left hand up control signal is generated. The next signal from the left or right hand angle sense device indicates a return to an inclination of less than 5° and the timing device initiates a 3 second time delay before recommencing the combined left and right up or down movement of the platform.

I claim:

1. A work platform control means for maintaining the platform in a substantially level position when being raised or lowered by two or more electrically powered hoists comprising an inclination sensing means that provide a signal should the platform be in an out of level position, and a circuit means that, (i) senses the signal of the inclination sensing means, and stops operation of said hoists when the platform is out of level, (ii) causes a first delay period, (iii) after said first delay period operates the hoist on the low side of the platform until the platform is substantially level, where upon the operation of the hoist is stopped, (iv) causes a second delay period, and (v) after said second delay period recommences operation of all said hoists to continue raising or lowering the platform.

2. A work platform control means according to claim 1 further comprising an inclination sensing means being provided in relation to each said hoist wherein when the platform is out of level an inclination sensing means indicates which hoist is to be operated to return the platform to a substantially level position.

3. A work platform control means according to claim 2 wherein said inclination sensing means comprise mercury switches having tubes with an arcuate shape and a pair of contacts at one end which provide a normally closed circuit until inclined to an angle or 5° or greater.

4. A work platform control means according to claim 3 wherein each said mercury switch is connected to a debounce circuit which provides a hysteresis delay to the opening or closing of the inclination sensing means.

5. A work platform control means according to claim 1 wherein there is provided a second inclination sensing means as a fail safe.

6. A work platform control means according to claim 5 wherein the said second inclination sensing device provides a signal when inclined at an angle of 8° or greater.

7. A work platform control means according to claim 1 wherein said inclination sensing means senses inclination about a transverse horizontal axis of the work platform, and wherein a further pair of inclination sensing means is provided to sense inclination about a longitudinal horizontal axis of the work platform.

8. A work platform control means according to claim 1 further comprising an over current circuit breaker and an emergency stop button wherein said circuit means, current circuit breaker and emergency stop button are in series and operation of either of them halts movement of the work platform.

9. A work platform control means according to claim 8 wherein the power source may be switched from the control means to provide earth leakage protected general purpose outlets.

* * * * *